US011253977B2

(12) United States Patent
Halbe

(10) Patent No.: US 11,253,977 B2
(45) Date of Patent: Feb. 22, 2022

(54) TURNING DEVICE FOR DECORATING TUMBLERS

(71) Applicant: CORWIN ROAD, L.L.C., Hiawatha, IA (US)

(72) Inventor: Mark Halbe, Cedar Rapids, IA (US)

(73) Assignee: Corwin Road, L.L.C., Hiawatha, IA (US)

( * ) Notice: Subject to any disclaimer, the term of this patent is extended or adjusted under 35 U.S.C. 154(b) by 113 days.

(21) Appl. No.: 16/669,986

(22) Filed: Oct. 31, 2019

(65) Prior Publication Data

US 2020/0156219 A1 May 21, 2020

Related U.S. Application Data

(60) Provisional application No. 62/769,806, filed on Nov. 20, 2018.

(51) Int. Cl.
*B25B 11/00* (2006.01)
*A47G 23/02* (2006.01)

(52) U.S. Cl.
CPC ..... *B25B 11/00* (2013.01); *A47G 23/02* (2013.01)

(58) Field of Classification Search
CPC ..... B05B 13/0228; B05C 13/025; B25Q 1/50; B25Q 1/52; B25Q 1/522; B25B 11/00; A47G 23/02
See application file for complete search history.

(56) References Cited

U.S. PATENT DOCUMENTS 4,103,589 A * 8/1978 Francis ..... B23Q 1/522 279/4.08
4,809,961 A * 3/1989 Anderson ..... B23Q 1/52 269/61
5,145,526 A * 9/1992 Oldham ..... B05B 13/0228 118/319
5,254,164 A * 10/1993 Masahumi ..... B05B 13/0242 118/319
5,284,229 A * 2/1994 Logan ..... B05C 5/0208 118/107
5,702,318 A * 12/1997 Hayafune ..... F02B 67/06 474/111
2002/0023582 A1* 2/2002 Kashihara ..... B05C 13/025 118/56
2011/0201465 A1* 8/2011 Kim ..... F16H 7/08 474/111

* cited by examiner

*Primary Examiner* — Seahee Hong
(74) *Attorney, Agent, or Firm* — Zarley Law Firm, P.L.C.

(57) ABSTRACT

A turning device for decorating a beverage container has a frame with a plurality of rotating rods that extend through the frame. Mounting dowels are connected to an end of each rotating shafts and a continuous chain is operatively connected to the plurality of rotating members. A motor is connected to an opposite end of one rotating member.

15 Claims, 8 Drawing Sheets

TURNING DEVICE FOR DECORATING TUMBLERS

CROSS REFERENCE TO RELATED APPLICATION

This application claims the benefit of the priority of U.S. Provisional Application No. 62/769,806 filed on Nov. 20, 2018, the contents of these applications are hereby incorporated by reference in their entirety.

BACKGROUND OF THE INVENTION

This invention is directed to a turning device and more particularly a turning device for applying epoxy to a decorated tumbler.

Decorating tumblers with glitter, spray paint, lettering, stickers and the like have become popular among people interested in making crafts. Typically, to provide a protective seal over the decorative design, a layer of epoxy is applied to the tumbler. This process can be messy, difficult, and time consuming. To assist in the application of applying epoxy, turning devices are used. While helpful, these devices are unreliable, limited to a specific size of tumbler, and limited to a single tumbler at a time.

An objective of the present invention is to provide a turning device that is more reliable.

Another objective of the present invention is to provide a turning device that is able to rotate more than one tumbler at a time.

These and other objectives will be apparent to those having ordinary skill in the art based upon the following written description, drawings, and claims.

SUMMARY OF THE INVENTION

A turning device has a frame with parallel spaced side walls. The side walls have a plurality of aligned and spaced side walls. Extending through the apertures and the side walls are a plurality of rotating members or shafts each having a sprocket with teeth. The rotating members are rotatably supported by bearings disposed within the apertures of the frame.

Connected to a first end of one rotating members is a motor. Connected to a second end of the rotating members are mounting dowels. A continuous chain is operating mounted to each of the rotating members.

Removeably connected to the mounting dowel is a tumbler mounting device. The tumbler mounting device connects a beverage container to the turning device.

DETAILED DESCRIPTION OF THE PREFERRED EMBODIMENTS

Figure 1:
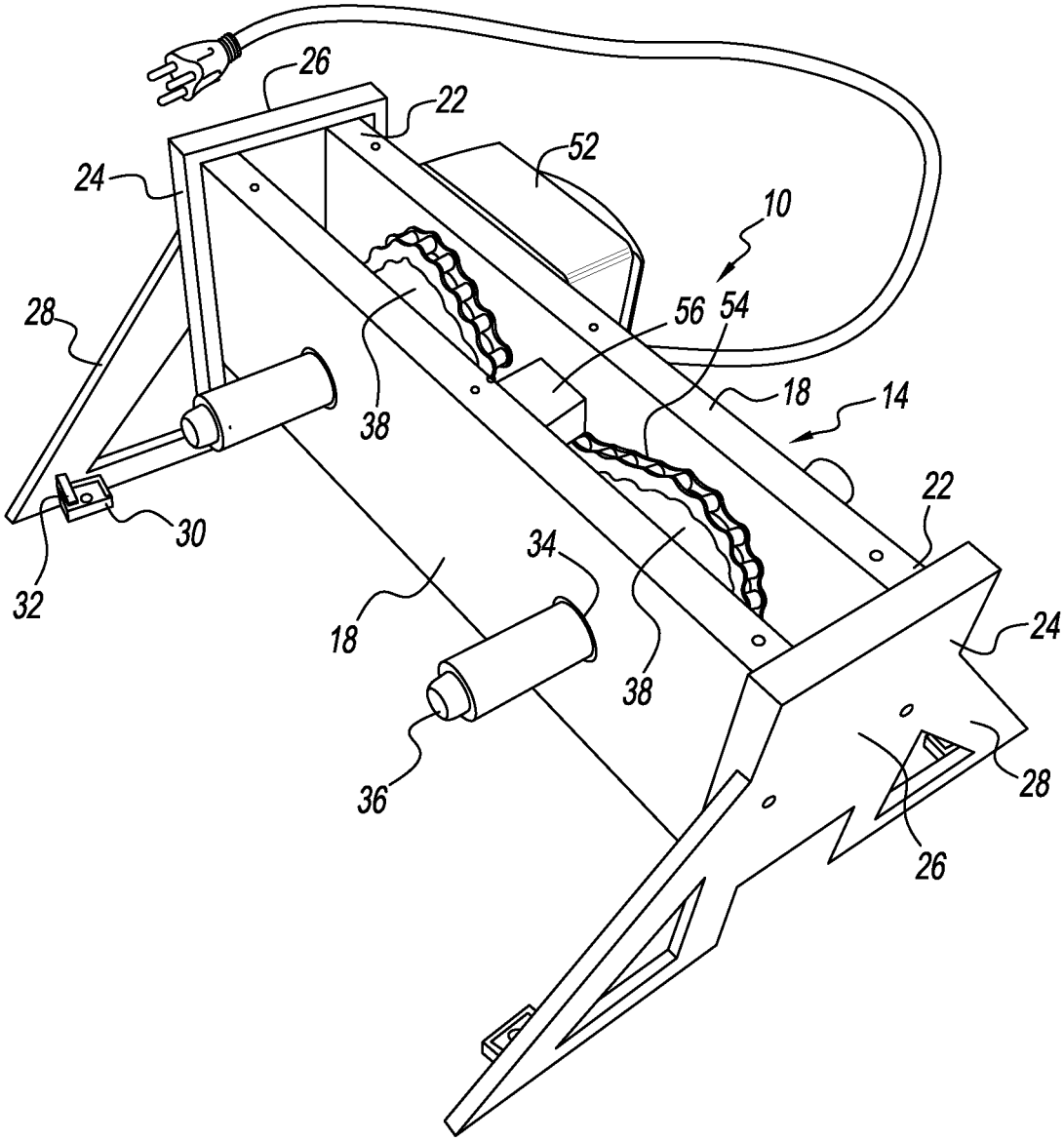
FIG. 1 is a perspective view of a turning device.
Figure 2:
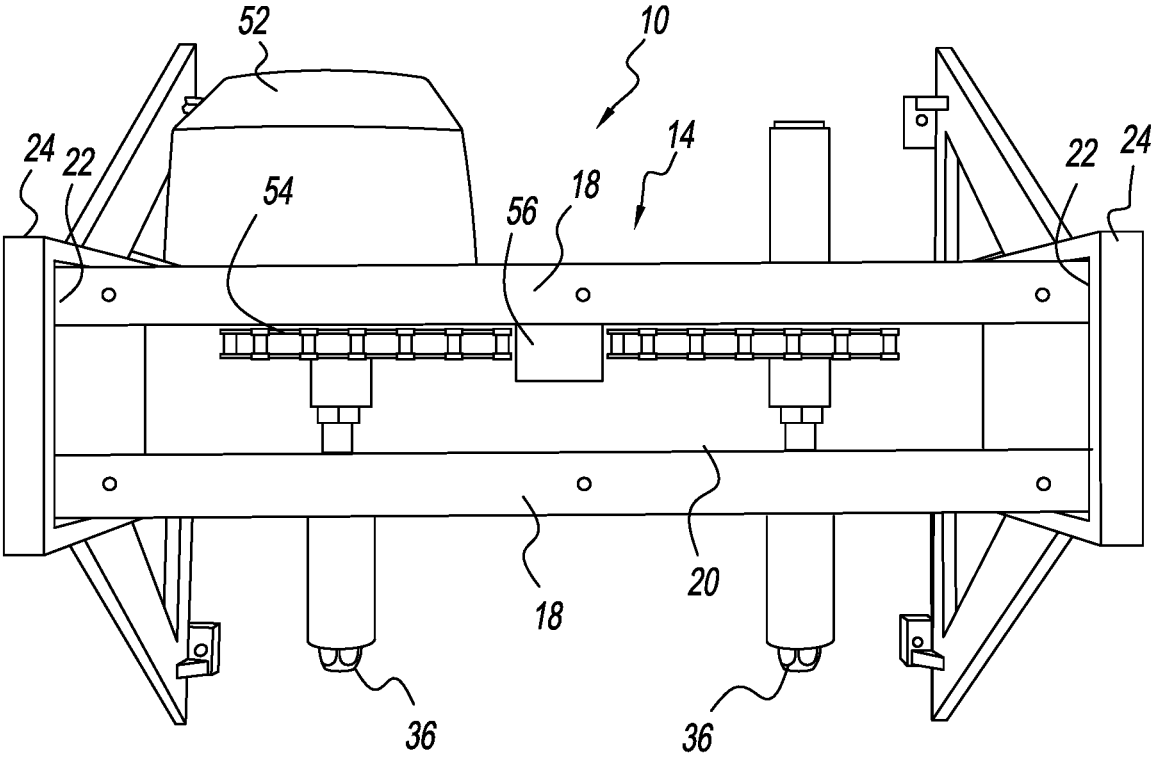
FIG. 2 is a top plan view of a turning device.
Figure 3:
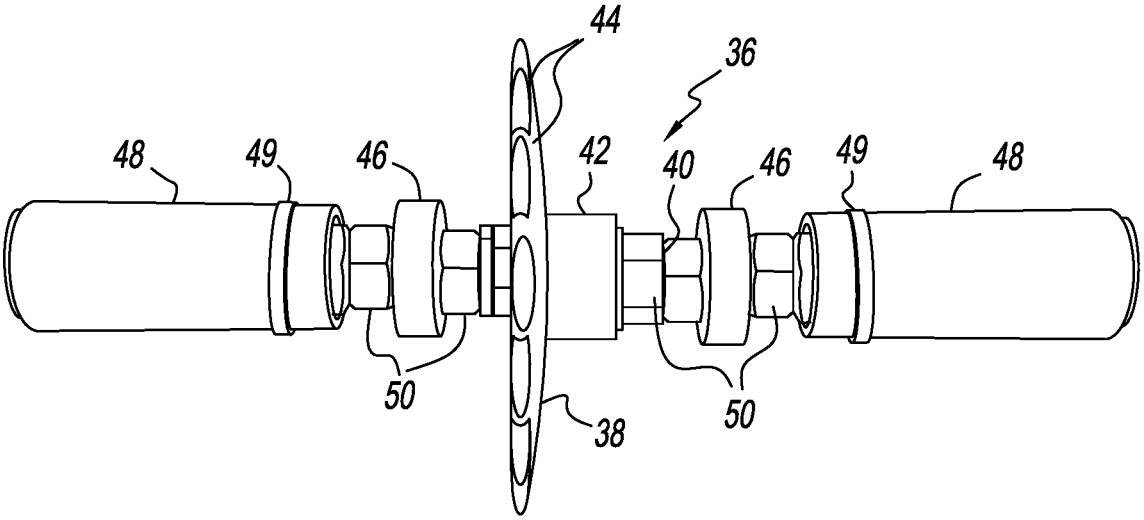
FIG. 3 is a top plan view of a rotating member.
Figure 4A:
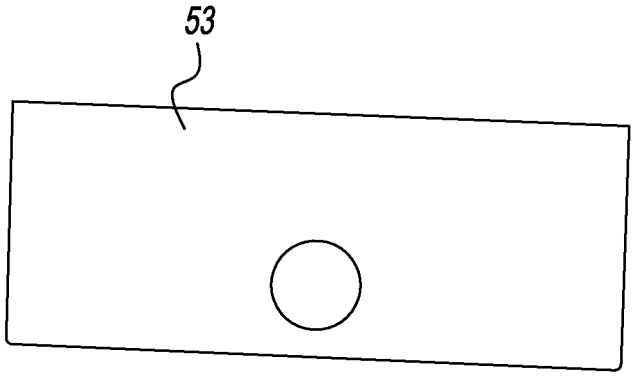
FIG. 4A is a side view of a mounting plate.
Figure 4B:
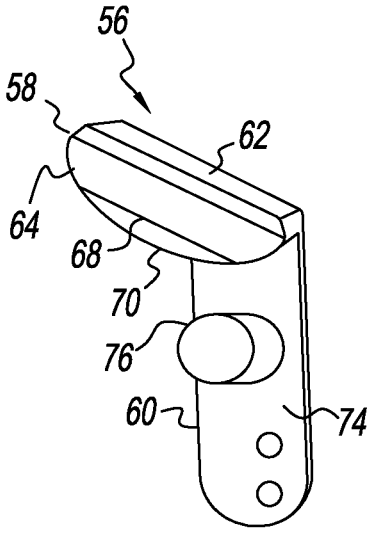
FIG. 4B is a side view of tensioning members.
Figure 4C:
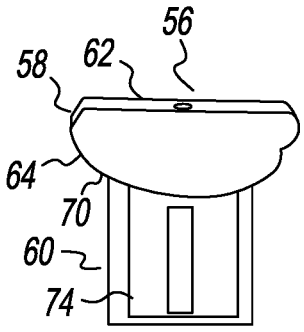
FIG. 4C is a side view of tensioning members.
Figure 4D:
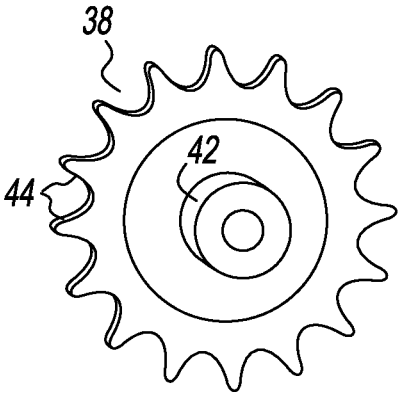
FIG. 4D is a side perspective view of a sprocket.
Figure 5:
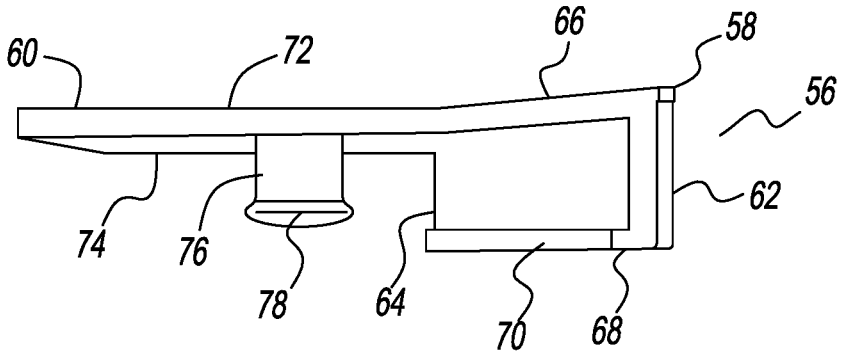
FIG. 5 is a perspective view of a tensioning member.
Figure 6:
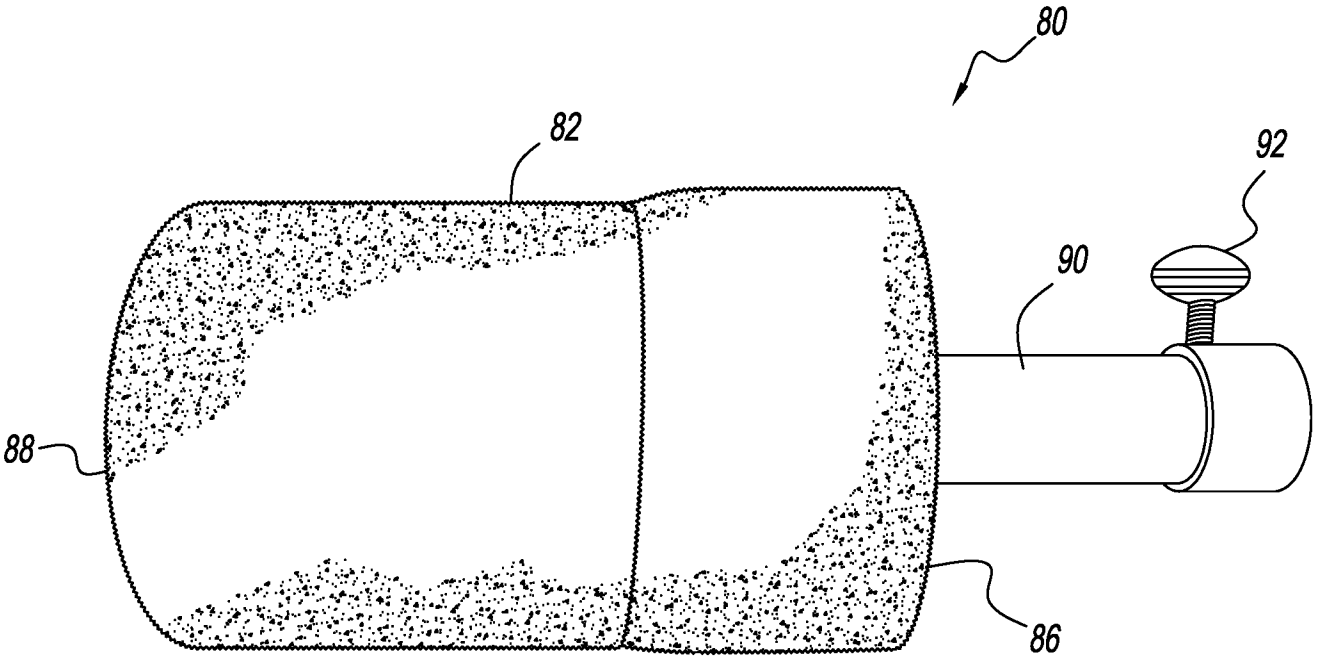
FIG. 6 is a top plan view of a tumbler mounting device.
Figure 7:
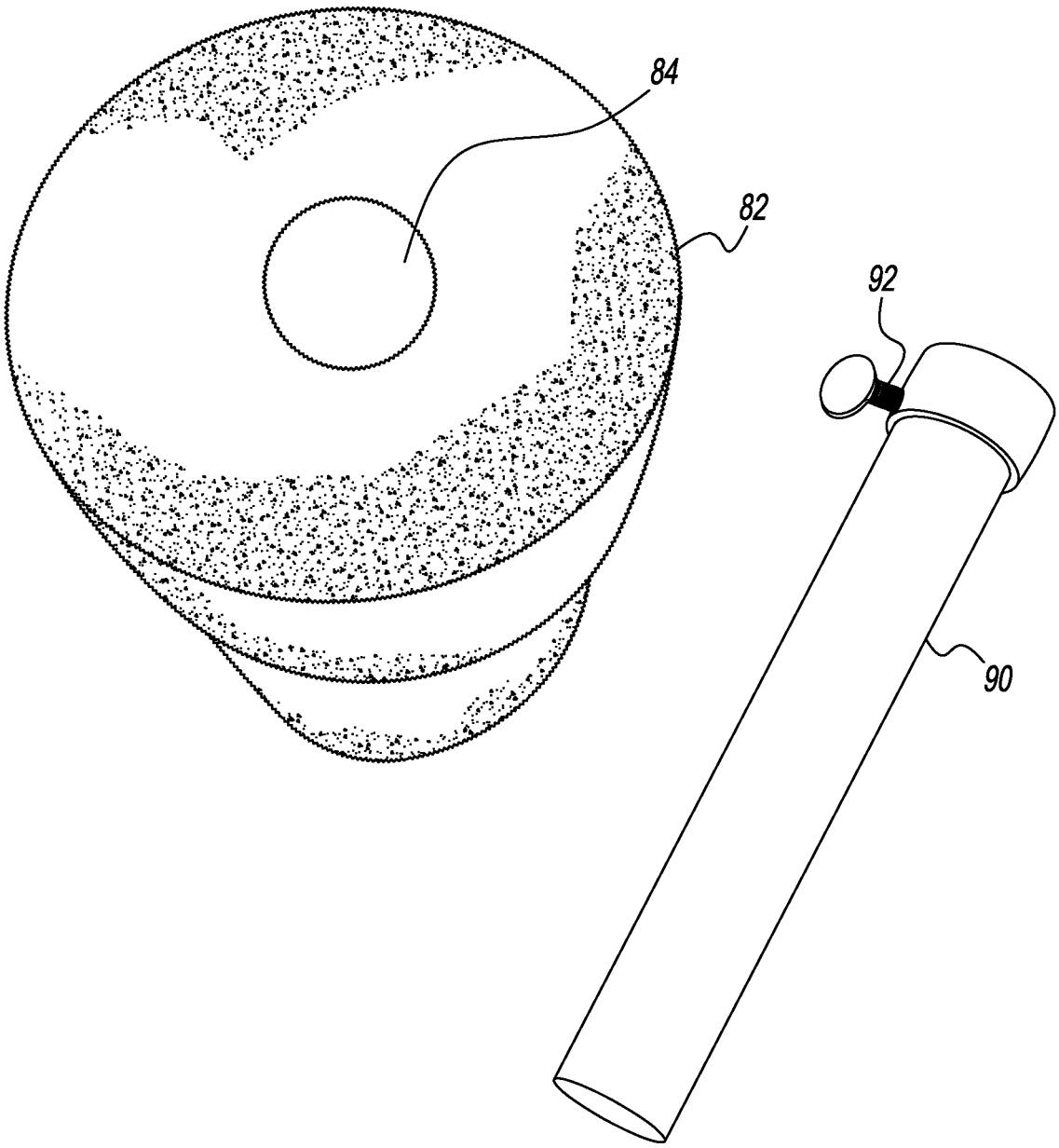
FIG. 7 is a perspective view of a tumbler mounting device.
Figure 8:
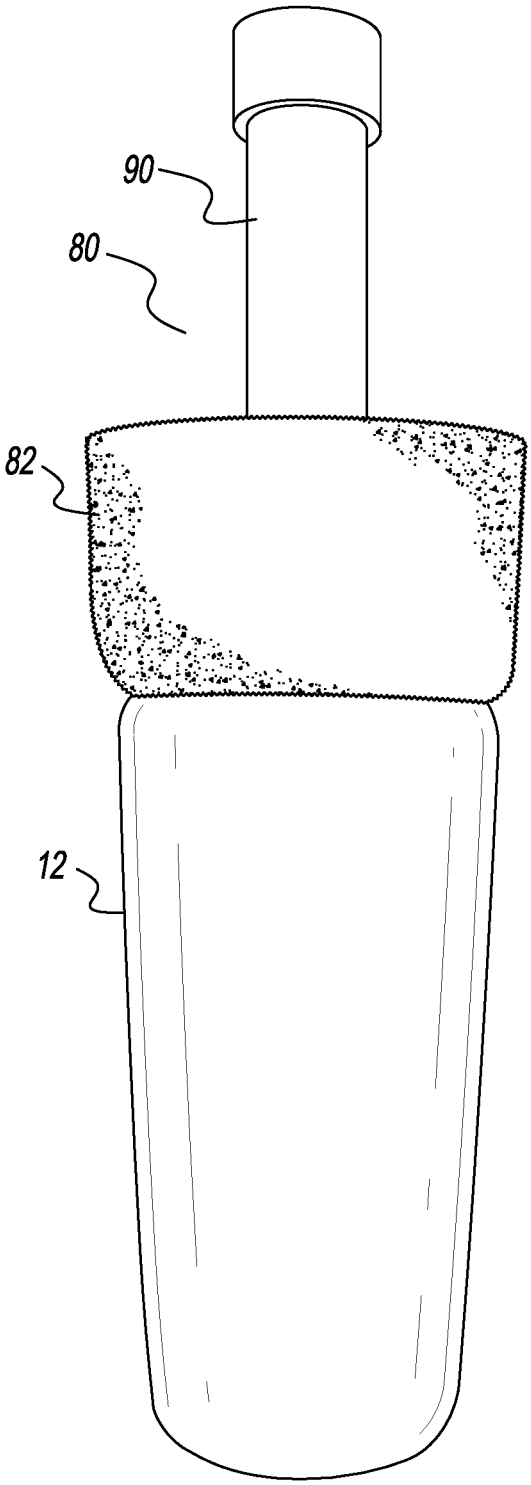
FIG. 8 is a top plan view of a beverage container connected to a tumbler mounting device.

Referring to the Figures, a turning device 10 for decorating tumblers 12 and other beverage containers such as wine glasses, coffee cups and the like has a frame 14. The frame 14 has a removeable top wall 16, a pair of parallel spaced side walls 18, a bottom wall 20, and a pair of ends 22. Connected to each end 22 is a support member or leg 24. The support member 24 is of any size, shape, or structure, and in the example shown has a rectangular section 26 that is connected to the end of the frame 14 and a pair of triangular sections 28 that extend outwardly and downwardly from the rectangular section 26. A stabilizing flange 30 with a brace 32 extends inwardly from the bottom of the triangular sections 28 toward the opposite support member 24 to provide additional stability.

The side walls 18 of the frame 14 have a plurality of horizontally aligned apertures 34 that receive a plurality of rotatable shafts 36. While the shafts 36 are of any size, shape, or structure, in one example, the shaft includes a sprocket 38 fixedly mounted generally in the center of a threaded rod 40. Preferably the sprocket 38 has a central opening that receives the rod 40, a hub 42 on one side, and a plurality of radially extending teeth 44 on an outer perimeter of the sprocket 38. Spaced from, and on each side of the sprocket 38, are a pair of bearings 46 that are rotatably mounted to the rod 40. The bearings 46 are spaced and positioned to dwell within the apertures 34 of the side walls 18. Fixedly mounted to the ends of the rod 40 are mounting dowels 48. At an end adjacent the bearings 46, the dowels 48 have a ridge 49 that extends around the diameter of the dowel 48. Separating the sprocket 38 from the bearings 46 and the bearings 46 from the dowels 48 are spacers 50.

Attached to one dowel 48 of one shaft 36 is a motor 52 that drives and rotates the shaft 36. In one example, a mounting plate 53 is used to connect the motor 52 to the side wall 18 of the frame 14. The plurality of shafts 36 are operatively connected to one another by a continuous chain 54 mounted to the teeth 44 of the sprockets 38. Mounted to a side wall 18 and positioned to engage the chain 54, is a tensioning member 56. The tensioning member 56 is of any size, shape, and structure. In one example, the tensioning member 56 has a body section 58 and a leg section 60. The body section 58 has a flat top wall 62, an arcuate bottom wall 64, a first side wall 66 and a second side wall 68. The first side wall 66 engages the side wall 18 of the frame 14 and the second side wall 68 extends from the top wall 62 past the bottom wall 64 to create a flange 70 that acts as a guide or stop. The first side wall 66 of the body section 58 terminates in the leg section 60 which preferably extends downwardly and outwardly from the body section 58 at an angle. The leg section 60 has a first side 72 that engages the side wall 18 of the frame 14 and a second side 74. Extending outwardly from the second side 74 is a guide member 76 having a flange 78 on its outer edge. The flange 78 on guide member 76 and the flange 70 on side wall 68 form a channel through which the chain 54 travels.

Removeably connected to the mounting dowel 48 is tumbler mounting device 80. The tumbler mounting device 80 is of any size, shape, and structure, and in one example, includes a cylindrical resilient member 82 preferably made of foam or the like. The resilient member 82 has a central bore 84 that extends from one end 86 to the opposite end 88. Frictionally received within the bore 84 is a hollow connecting tube 90. The connecting tube 90 has a tightening screw 92 that extends through a wall of the tube 90.

In operation, after the tumbler 12 has been decorated and prior to applying epoxy, the resilient member 82 of the tumbler mounting device 80 is inserted into the opening of the tumbler 12. Because the resilient member 82 is compressible, it is adapted to fit a variety of different sizes of tumblers 12. Next, connecting tube 90 is inserted over the mounting dowel 48. The end of the connecting tube 90 engages the ridge 49 on the mounting dowel 48 to prevent the connecting tube 90 from engaging the side wall 18 of the frame 14. By creating a space, the connecting tube 90 does not push against the side wall 18 which interferes with the operation of the motor 52. Once positioned on the mounting dowel 48, the tightening screw 92 is tightened to engage the mounting dowel 48 and secure the connecting tube 90 to the mounting dowel 48. This process is repeated for additional tumblers 12.

Once secured, the motor 52 is activated causing the shafts 36 to rotate, which in turn causes the sprocket 38, mounting dowels 48, and tumblers 12 to rotate. The chain 54, which travels along the arcuate bottom wall 64 of the tensioning member 56 causes adjacent sprockets 38, shafts 36, mounting dowels 48, and tumblers 12 to rotate. As the tumblers 12 rotate, epoxy is applied to the tumblers 12 in a smooth even manner.

From the above discussion and accompanying figures and claims it will be appreciated that a turning device 10 offers many advantages over the prior art. It will be appreciated further by those skilled in the art that other various modifications could be made to the device without parting from the spirit and scope of this invention. All such modifications and changes fall within the scope of the claims and are intended to be covered thereby. It should be understood that the examples and embodiments described herein are for illustrative purposes only and that various modifications or changes in the light thereof will be suggested to persons skilled in the art and are to be included in the spirit and purview of this application.

What is claimed is:

1. A turning device comprising:

a frame having a pair of side walls;

a plurality of rotatable shafts received through aligned apertures in the pair of sidewalls;

each of the plurality of rotatable shafts having a threaded rod, a sprocket mounted to the threaded rod, and a mounting dowel fixedly mounted to opposing ends of the threaded rod;

a motor operatively attached to one of the plurality of rotatable shafts by a continuous chain;

a tumbler mounting device removably connected to one of the mounting dowels; and the tumbler mounting device having a resilient member and a connecting tube configured to connect to one of the mounting dowels.

2. The device of claim 1 further comprising the frame a bottom wall and a pair of ends.

3. The device of claim 2 further comprising a support member connected to each of the pair of ends.

4. The device of claim 3 further comprising the support member having a rectangular section and a pair of triangular sections that extend outwardly and downwardly from the rectangular section, wherein the rectangular section connects to one of the pair of ends.

5. The device of claim 4 further comprising a stabilizing flange extending from a bottom of each of the triangular sections, wherein the stabilizing flange extends inwardly.

6. The device of claim 5 further comprising a brace connected to the stabilizing flange.

7. The device of claim 1 further comprising a pair of bearings rotatably mounted on the threaded rod on each side of the sprocket.

8. The device of claim 7 further comprising a ridge extending around the diameter of the mounting dowel, wherein the ridge is positioned adjacent one of the pair of bearings.

9. The device of claim 7 further comprising a plurality of spacers positioned on the threaded rod, wherein one of the plurality of spacers is positioned between the sprocket and the pair of bearings and the pair of the bearings and the mounting dowels.

10. The device of claim 1 further comprising the resilient member having a bore that extends from one end of the resilient member to an opposite end.

11. The device of claim 10 further comprising the connecting tube frictionally received within the bore of resilient member, wherein the connecting tube is hollow and configured to be received over one of the mounting dowels.

12. The device of claim 11 further comprising the connecting tube having a tightening screw that extends through and into the connecting tube, wherein the tightening screw is configured to secure the connecting tube to one of the mounting dowels.

13. The device of claim 1, wherein a tensioning member is mounted to one of the pair side walls.

14. The device of claim 13 further comprising the tensioning member having a flat top wall, an arcuate bottom wall, a first side wall that engages the one of the pair of parallel spaced side walls, and a second side wall that extends from the flat top wall past the bottom wall thereby forming a flange configured to act as a guide; and a leg section having a first side that engages one of the pair of the parallel spaced side walls and a second side having a guide member with a flange on an outer edge, wherein the guide member extends outwardly from the second side.

15. The device of claim 14 wherein the first side wall of the body section terminates in the leg section and the leg section extends downwardly and outwardly from the body section at an angle; and wherein the flange of the body section and the flange of the leg section are configured to receive and channel the continuous chain between the flange of the body section and the flange of the leg section.

* * * * *